US006378785B1

(12) United States Patent
Dodd

(10) Patent No.: US 6,378,785 B1
(45) Date of Patent: Apr. 30, 2002

(54) HOSE-END ASPIRATION-TYPE SPRAYER

(75) Inventor: Joseph K. Dodd, Lee's Summit, MO (US)

(73) Assignee: Saint-Gobain Calmar Inc., City of Industry, CA (US)

( * ) Notice: Subject to any disclaimer, the term of this patent is extended or adjusted under 35 U.S.C. 154(b) by 0 days.

(21) Appl. No.: 09/650,635

(22) Filed: Aug. 30, 2000

(51) Int. Cl.[7] ..... B05B 7/30
(52) U.S. Cl. ..... 239/318; 239/394
(58) Field of Search ..... 239/318, 394, 239/242

(56) References Cited

U.S. PATENT DOCUMENTS

| | | | | |
|---|---|---|---|---|
| 2,612,403 A | | 9/1952 | Burch | |
| 2,761,734 A | | 9/1956 | Farmer | |
| 3,034,731 A | | 5/1962 | Chapin | |
| 3,186,643 A | | 6/1965 | George et al. | |
| 3,201,049 A | | 8/1965 | Hayes | |
| 3,204,875 A | | 9/1965 | Langstroth | |
| 3,255,972 A | | 6/1966 | Hultgren et al. | |
| 3,964,689 A | | 6/1976 | Horvath, Jr. et al. | |
| 4,171,070 A | | 10/1979 | Colgate et al. | |
| 4,315,601 A | | 2/1982 | Brooker | |
| 4,369,921 A | * | 1/1983 | Beiswenger et al. | 239/318 X |
| 4,475,689 A | | 10/1984 | Hauger et al. | |
| 4,508,272 A | | 4/1985 | Thompson | |
| 4,527,740 A | * | 7/1985 | Gunzel, Jr. et al. | 239/318 |
| 4,736,891 A | | 4/1988 | Chow et al. | |
| 4,750,674 A | * | 6/1988 | Chow et al. | 239/318 |
| 4,901,923 A | | 2/1990 | McRoskey et al. | |
| 5,100,059 A | | 3/1992 | Englhard et al. | |
| 5,213,265 A | | 5/1993 | Englhard et al. | |
| 5,320,288 A | | 6/1994 | Ketcham et al. | |
| 5,383,603 A | | 1/1995 | Englhard et al. | |
| 5,626,291 A | | 5/1997 | Flinn et al. | |
| 5,881,955 A | | 3/1999 | Styne | |

* cited by examiner

*Primary Examiner*—Lesley D. Morris
(74) *Attorney, Agent, or Firm*—Dykema Gossett PLLC

(57) ABSTRACT

An aspiration-type sprayer assembly adapted for being coupled to both the end of the hose and to a chemical container has a housing including a carrier liquid inlet passage, a chemical liquid inlet passage and a discharge passage. The cylindrical rotatable valve within the housing has a carrier liquid duct and a chemical liquid duct opening into the carrier duct for interconnecting the inlet passage in a first rotative position of the valve, and the valve is capable of closing the inlet passages in a second rotative position of the valve. The rotatable nozzle versus the discharge in selective directions, and the assembly is capable of being manipulated by the provision of a handle grip. An anti-siphon assembly is provided at the coupling between the sprayer housing and the water hose end to avoid pressure and back flow from the sprayer. And chemical/water mix can be exchanged substituting the various tube retainers having different size inlet ports.

33 Claims, 4 Drawing Sheets

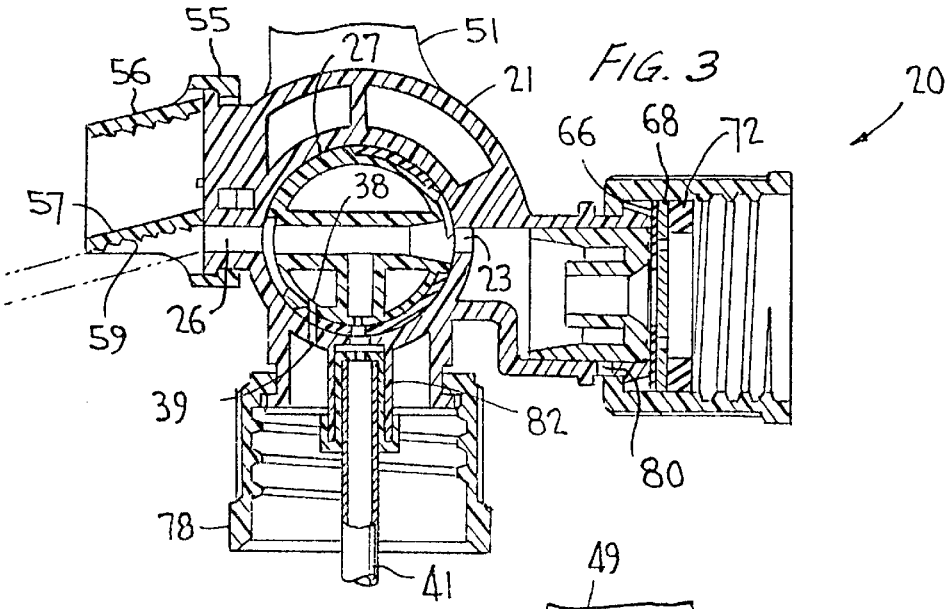
FIG. 3
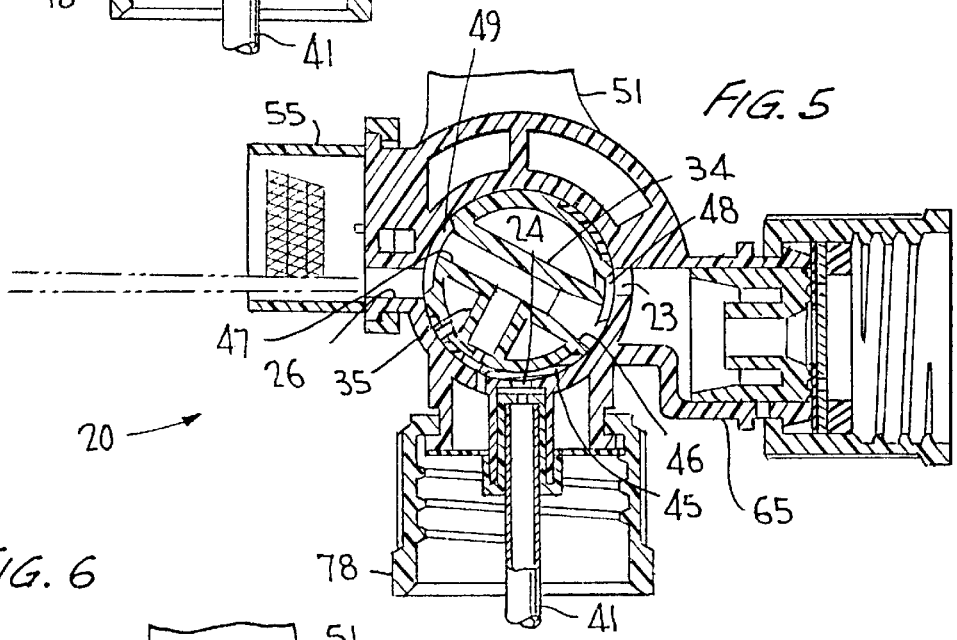
FIG. 5
FIG. 6
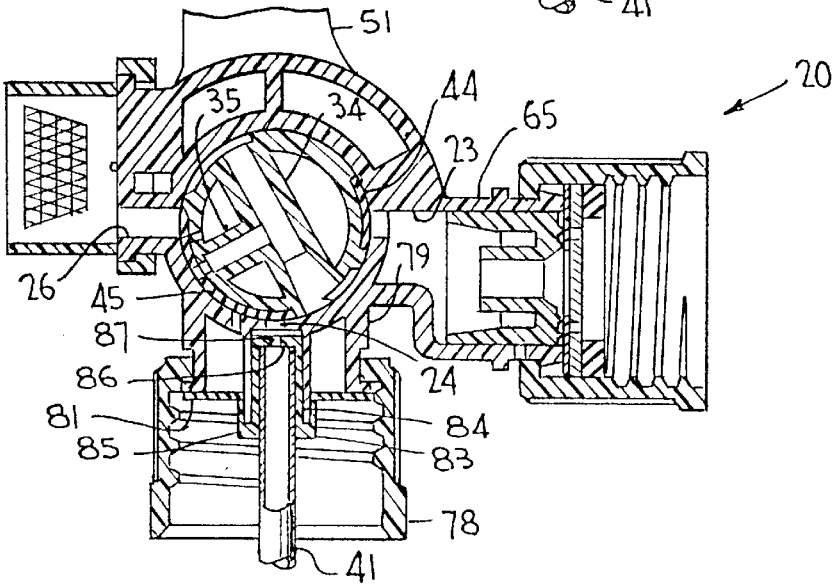

HOSE-END ASPIRATION-TYPE SPRAYER

BACKGROUND OF THE INVENTION

This invention relates generally to an aspiration-type dispenser adapted to be connected to a source of pressurized carrier liquid, such as a garden hose, and further adapted to be coupled to a container of chemical liquid to be diluted upon aspiration.

Aspiration-type dispensers of the general type afore-described are known, for example, from U.S. Pat. Nos. 5,383,603, 5,320,288 and 5,100,059. In each of these patents a cylindrical valve is disclosed for controlling the flow of the carrier liquid except that aspiration takes place generally downstream thereof thereby requiring an elongated and more complex structure which includes additional ducting and passageways. Also, parts and details required for these known sprayers add to the cost of manufacturing and assembly, which is undesirable. Moreover, the known aspiration-type sprayers are not user friendly and have limited features which have stimulated the need for many improvements.

SUMMARY OF THE INVENTION

It is therefore an object of the present invention to provide a sprayer assembly for connection to a container of a liquid chemical to be diluted upon aspiration by a pressurized stream of carrier liquid, which has a minimum number of parts, is compact and economical yet highly efficient in aspirating the chemical liquid in a most convenient and user friendly manner.

Another object of this invention is to provide such an assembly which comprises a housing having a carrier liquid and chemical liquid inlet passages and a discharge passage. A rotatable valve located within the housing has a carrier liquid duct and an intersecting chemical liquid duct interconnecting the inlet passages in a first rotative position of the valve, and the inlet passage is closed by the valve in a second rotative position thereof.

Further object of the present invention is to provide such an assembly wherein the housing has couplings for connection to a source of the carrier liquid and to a container of the liquid chemical, the housing having an integral handle to be grasped by the user for holding the sprayer assembly when spraying, the handle extending outwardly from an upper wall of the housing and having a gripper bar for hand holding.

Another object is to provide such an assembly wherein a diverter is mounted downstream of the discharge end of the housing, the diverter having a wall sloping in one direction lying along the path of the discharge passage for deflecting the liquid flow from the discharge passage to effect a flat spray pattern in that one direction.

Another object is to provide an assembly with such a diverter in the form of a rotatable nozzle having a pair of spaced sloping walls lying in the path of the discharge passage upon nozzle rotation for selectively deflecting the liquid flow in one or another direction.

A still further object of this invention is to provide such a sprayer assembly wherein the housing has a support sleeve coaxial with its chemical inlet opening, a dip tube retainer being coupled to such sleeve, the retainer having a cylindrical wall for suspending the dip tube extending into the chemical container, and the retainer having a transverse wall with an inlet orifice coaxial with the chemical inlet opening, the orifice being of a predetermined size to effect a given chemical liquid-to-carrier liquid ratio.

Another object of the invention is to provide such an assembly wherein carrier liquid inlet and chemical liquid inlet passages extend into a cylindrical bore of the housing and the discharge passage extends from the bore which extends transversely to the passages, the cylindrical valve is rotatable within the bore about its central axis thereof between on and off positions, the valve having annular seal rings at opposite ends in engagement with the bore, and the entirety of the valve being of an injection molded polymeric material wherein the seal rings are of more softer and more compliant material compared to that of the valve material.

A still further object of this invention is to provide such an assembly wherein the coupler for connecting the housing to the liquid carrier source includes an anti-siphon means which permits only one-way flow of carrier liquid in a downstream direction of the housing via through the carrier liquid inlet passage.

Other objects, advantages and novel features of the invention will become more apparently from the following detailed description of the invention when taken into conjunction with the accompanying drawings.

BRIEF DESCRIPTION OF THE DRAWINGS

FIG. 3 is a view similar to FIG. 2, the valve shown in its on position with the spray diverted downwardly;

FIG. 5 is a view similar to FIG. 2 showing the valve in a rotative position with the water carrier inlet open and the chemical inlet closed in a rinse position;

FIG. 6 is a view similar to FIG. 2 with the valve rotated to its off position;

DETAILED DESCRIPTION OF THE INVENTION

Figure 1:
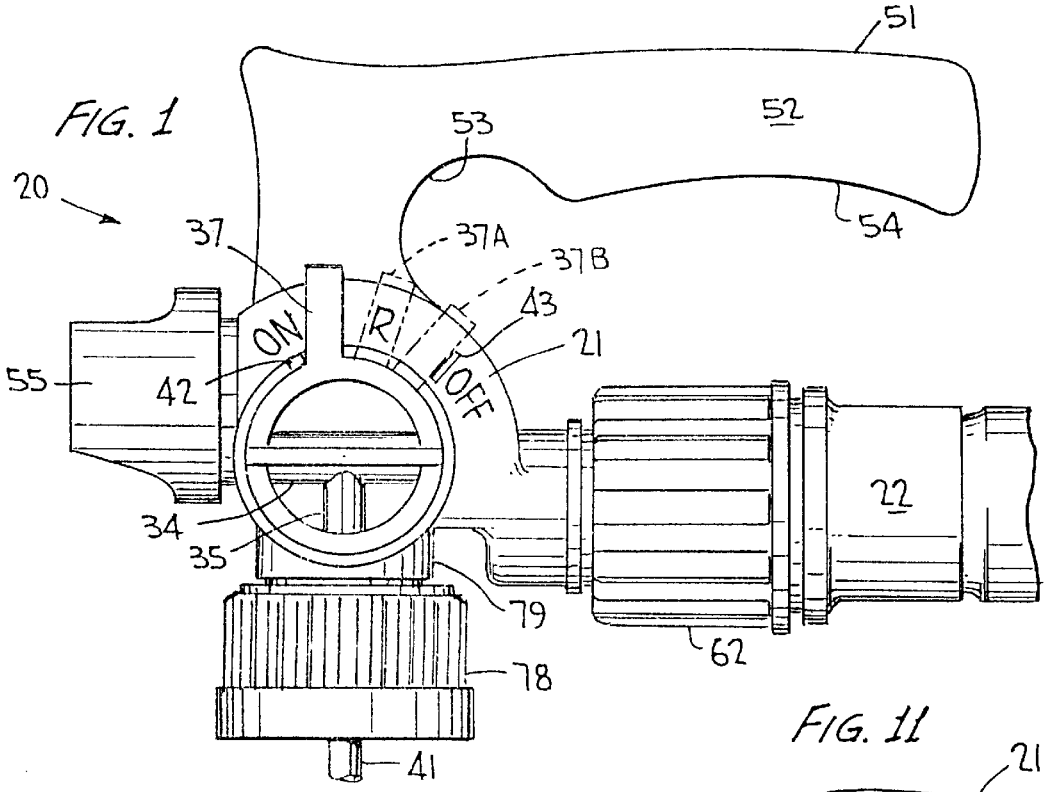
FIG. 1 is a side elevational view of a sprayer assembly according to the invention shown coupled to the end of a hose.

Turning now to the drawings wherein like reference characters refer to like and corresponding parts throughout the several views, the sprayer assembly according to the invention is generally designated 20, the assembly having a housing 21 coupled to both container C (FIG. 2) of liquid chemical, and coupled to a source of pressurized carrier liquid such as via the end of a garden hose 22 which extends from a standard water faucet (not shown).

Applied to one side of the housing indicia is ON, OFF, or RINSE to identify the three positions of the sprayer to be described in more detail hereinafter.

Figure 2:
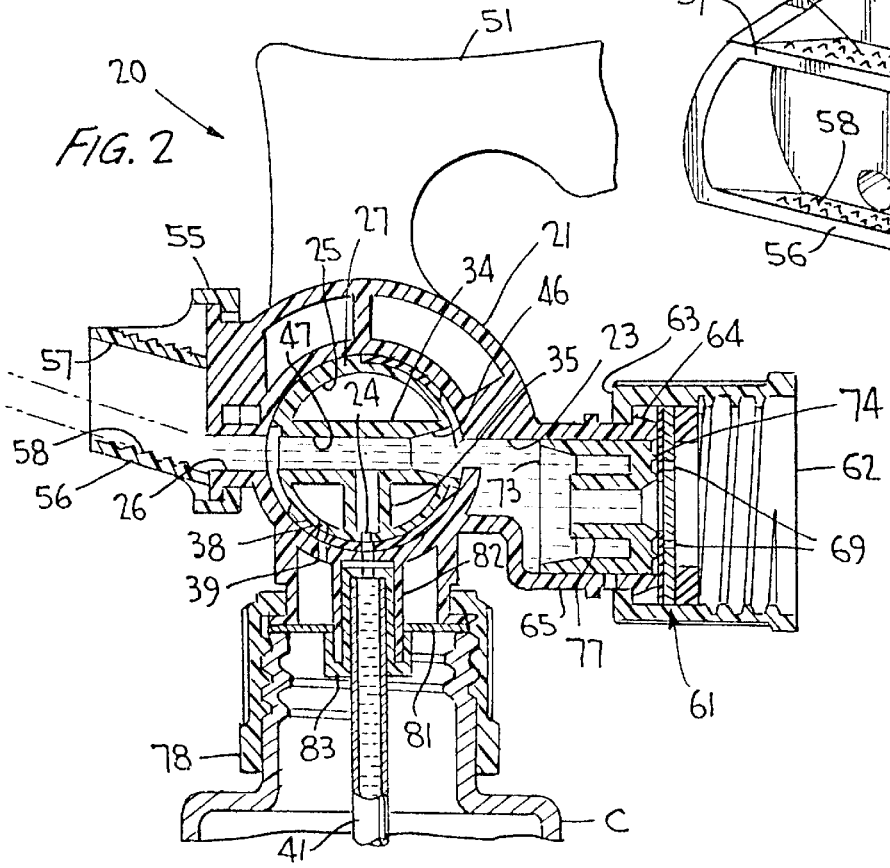
FIG. 2 is a view similar to FIG. 1 showing a structural detail end section, the valve shown in an open position with the spray diverted upwardly.

As more clearly shown in FIG. 2, the housing has a carrier liquid inlet passage 23 and a chemical liquid inlet passage or opening 24 lying along perpendicular axes and extending into a transverse bore 25 of the housing. A discharge passage 26 extends from the transverse bore of the housing and may be coaxial with or parallel and offset to carrier liquid inlet passage 23.

Figure 8:
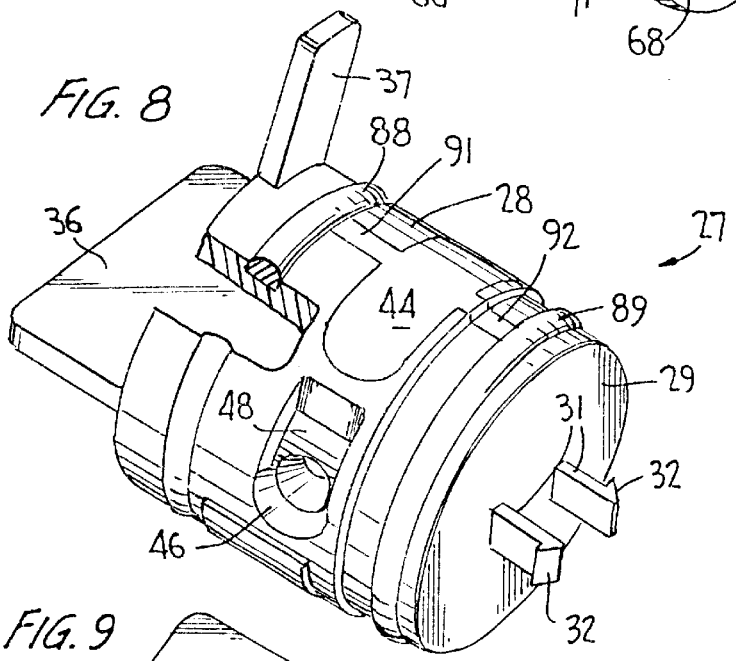
FIG. 8 is an enlarged perspective view of the cylindrical valve according to the invention in one rotative position.
Figure 9:
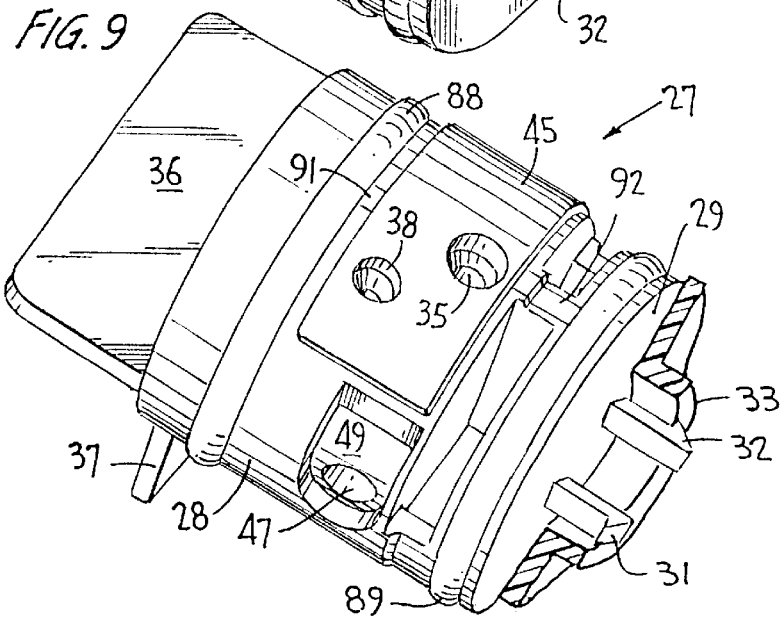
FIG. 9 is a view similar to FIG. 8 of the valve shown in another rotative position.

Rotatably mounted within the bore is a cylindrical valve 27 shown in perspective in FIGS. 8 and 9. The valve has a cylindrical outer wall 28 and may be closed at one end by an end wall 29. A pair of spring legs 31, extending outwardly of wall 29, are adapted to extend through a central opening of a confronting wall 33 of the housing (FIG. 9), the legs having barbs 32 snapping behind an edge of the central opening to retain the cylindrical valve in place within the housing.

The valve has, as more clearly shown in FIGS. 2 to 6, a carrier liquid inlet duct 34 extending along the diameter of the cylindrical valve, and a radially extending chemical liquid duct 35 in open communication with duct 34. And the cylindrical valve has a turning tab 36 or the like (FIGS. 8, 9) to be grasped by the operator for rotating the valve about its central axis, and an indicator bar 37 or the like extending outwardly of its external wall 28. Extending through wall 28 of the valve is a vent port 38 which, in one of the open positions of FIG. 2, is in alignment with a corresponding vent port 39 provided in the housing.

A dip tube 41 is coupled to the housing and extends into the liquid of container C to be aspirated.

The cylindrical valve is shown in FIGS. 1, 2 and 3 in its ON position in that it has been rotated manually into that position as confirmed by indicator 37 lying adjacent the ON marking on the housing. In that position a detent 42 (FIG. 1) may be provided on the housing for arresting further counterclockwise rotation of the cylindrical valve from that shown in FIGS. 1 to 3.

In the ON position, as clearly shown in FIG. 2, the carrier liquid, i.e., water under pressure from the open garden hose, passes through inlet passage 23 and as the liquid stream passes over the inner opening of duct 35 the chemical product is aspirated or drawn from the container up the dip tube and into the carrier liquid stream so as to be thereby diluted as the water and chemical mix is discharged through the assembly via discharge passage 26.

Referring to FIG. 6, valve 27 is shown rotated clockwise until the indicator bar stops at position 37B shown in FIG. 1, at which it abuts against a stop element 43 on the housing in an OFF position. Ducts 34, 35 are thus rotated completely out of alignment with the passages in the housing such that an elastomeric section 44 on the outer periphery of the cylindrical valve (FIG. 8) to be described in more detail hereinafter, overlies carrier liquid inlet passage 23 for sealing the same tightly closed. Also in the FIG. 6 position, an external seal portion 45 (FIG. 9) on the periphery of valve 27 seals tightly over chemical liquid inlet passage 24.

Referring now to FIG. 5, the outer surface of cylindrical wall 28 of the valve is notched as to provide a depression 48 which opens into upstream end 46 of duct 34 (see also FIG. 8). Similarly, the outer surface of cylindrical wall 28 of the valve is notched to form a depression 49 (FIG. 9) which communicates with downstream end 47 of duct 34 when the valve is rotated into its FIG. 5 position as confirmed by the position 37A of indicator bar 37 shown in FIG. 1. The assembly has been rotated into its RINSE position as indicated by the indicia R in FIG. 1. In such position, seal portion 45 on the outer periphery of the valve overlies chemical liquid inlet passage 24 in tight sealing relationship for sealing it closed. However, duct 34 is in open communication with carrier liquid inlet passage 23 and with discharge passage 26 via their respective depressions 48 and 49. The assembly may therefore be rinsed for cleansing the assembly prior to attaching a container of another chemical to this assembly if desired. Moreover, the operator can in the rinse R position simply spray or apply a stream of liquid to the plants or grass in the garden without the need to uncouple the assembly from the hose end.

In accordance with another feature of the invention, the sprayer assembly can be conveniently, comfortably and securely held by the hand of the operator during use by the provision of a handle 51 integrally formed with housing 21 and extending upwardly from an upper wall thereof. The handle has a gripper bar 52 which may be contoured on its underside to provide a finger rest indentation 53 and a contour 54 along its lower edge. The gripper bar extends in an upstream direction substantially parallel to the longitudinal axis of housing 21.

Yet another feature of the invention is the provision of a diverter for deflecting the stream of liquid from the discharge passage in the form of a flat spray dispersed over a wide area. A rotatable nozzle 55 is mounted at the downstream end of the housing, as shown in FIGS. 1 to 6 and in more detail in FIG. 11. The nozzle has a pair of spaced apart deflector plates 56, 57, and the nozzle when mounted in place has its central axis offset from the axis of discharge passage 26.

Figure 11:
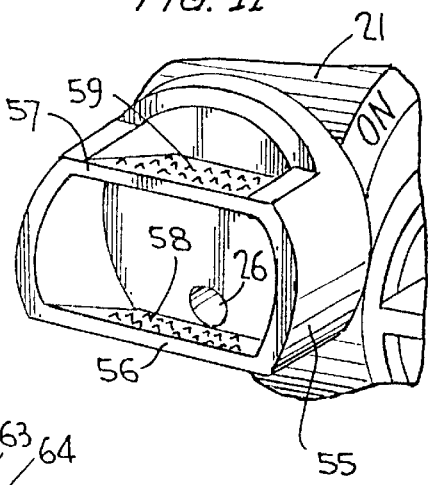
FIG. 11 is a perspective view of the diverter nozzle of the invention shown in FIGS. 2 to 6.

In the manually rotated position of the nozzle shown in FIGS. 2 and 11, deflector plate 56 is positioned such that its inner surface 58 is in the path of the liquid flow through the discharge passage such that the liquid is thereby deflected in an upward direction.

On rotation of the nozzle through 180° shown in FIG. 3, deflector plate 57 is positioned such that its outer surface 59 lies in the path of the flow of liquid through the discharge passage, thereby diverting the flow in a downward direction as shown. In the FIG. 3 position, the valve 27 is in the same rotative ON position as in FIG. 2.

In each of the diverted spray up or spray down positions of FIGS. 2 and 3, the stream of liquid flowing through the discharge passage forms flat sprays over a wide area. To enhance the dispersion and to create a spray of bubbles surfaces 58 and 59 may be roughened as shown in some known manner.

Figure 4:
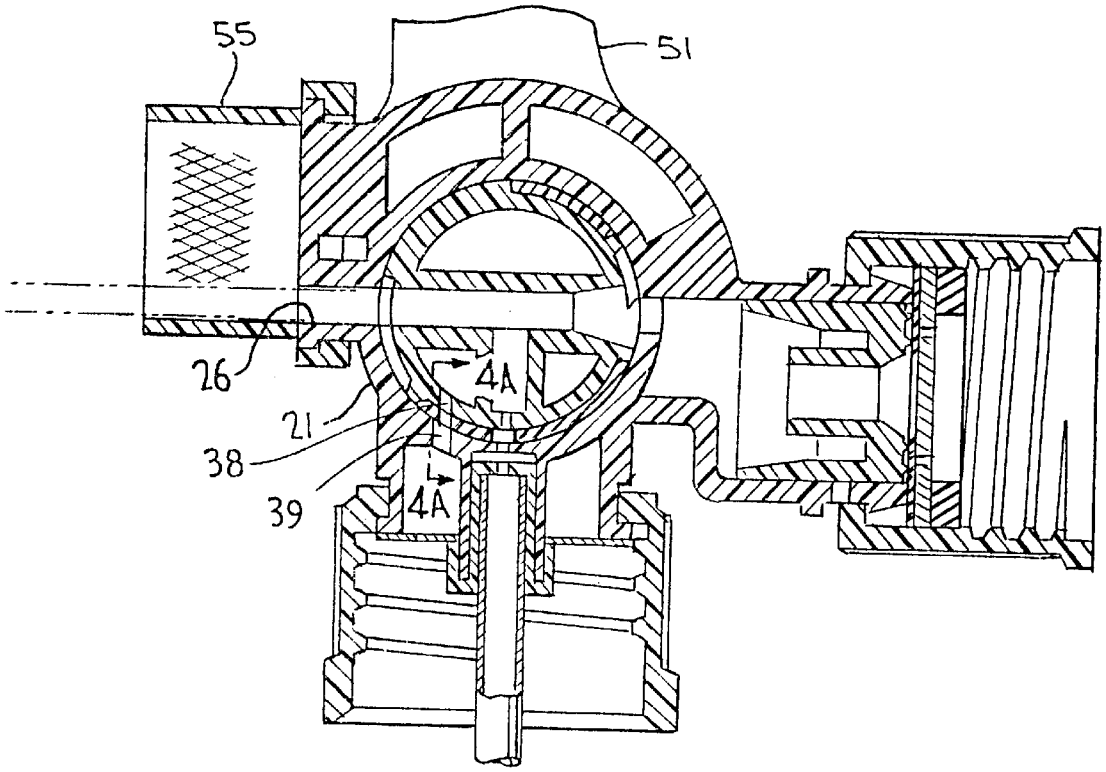
FIG. 4 is a view similar to FIG. 2, the valve shown in its on position with the spray being undiverted.

In the FIG. 4 position with the valve likewise in an ON position, rotatable nozzle 55 is rotated such that neither of surfaces 58 or 59 of the deflector plates is in the path of the flow of liquid through discharge passage 26. The liquid flow is thus not deflected but instead emerges as a stream as shown.

Likewise in the RINSE position of FIG. 5, nozzle 55 is shown rotated to the same position as in FIG. 4 in which neither of surfaces 58 or 59 of the deflector plates is in the path of the discharge passage. Thus in the RINSE position the flow of liquid emerges as a stream from the discharge passage.

Figure 4A:
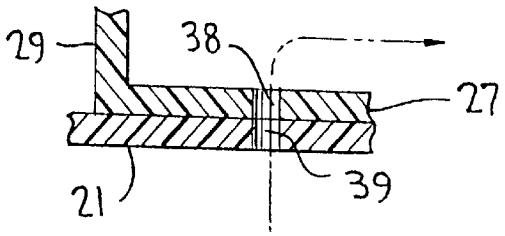
FIG. 4A is a cross-sectional view taken substantially along the line 4—4 of FIG. 4.

It can be seen that in the ON positions of FIGS. 2, 3 and 4, vent ports 38 and 39 are aligned for venting the interior of the container to atmosphere via the open end of the cylindrical valve as shown in FIG. 4A. However, in the RINSE position of FIG. 5 and in the OFF position of FIG. 6, vent port 38 in the valve and vent port 39 in the housing are misaligned to thereby close the vent path to avoid leakage of chemical from the container in the OFF position if the assembly is placed on its side.

Figure 7:
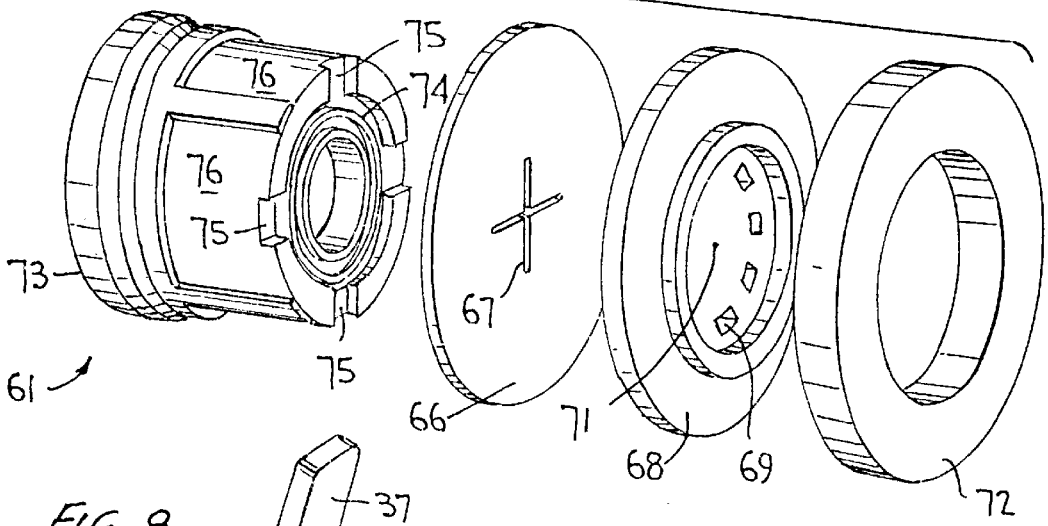
FIG. 7 is an expanded perspective view of an anti-siphon assembly of the invention at the carrier inlet coupler end which is shown assembled together in FIGS. 2 to 6.

When spraying chemicals in the lawn or garden, such as pesticides and the like, the concern arises that chemical could be drawn into the water supply which is not only undesirable but potentially hazardous. To avoid this potential problem an anti-siphon assembly generally designated 61 in FIG. 7 has been devised. Referring to FIGS. 2 to 6, housing 21 is coupled to hose end 22 (FIG. 1) by the provision of the standard internally threaded coupler 62 having an inwardly directed flange 63 in engagement with an external snap bead 64 at the distal end of conduit 65 which together with the inlet port leading into the bore 25 of the housing, defines the carrier liquid inlet passage. Assembly 61 includes a valve disc 66, which may be of elastomeric material, the disc having a central cruciform opening 67 which defines a one-way valve therethrough. The assembly further comprises a flow regulator 68 having a plurality of carrier liquid inlet openings 69 in a circular array, the diameter of the circle exceeding the size of the opening 67 such that the opening abuts against an imperforate inner portion 71 of the regulator. A standard hose washer 72 is located upstream of the flow regulator, and a cylindrical seal 73 is mounted within conduit 65 on the downstream side of valve disc 66. Seal 73 is resilient and has a seal ring 74 in sealing engagement with valve disc at a diametral location outwardly of openings 69.

Cylindrical seal 73 at its upstream face has a plurality of notches 75 opening into cutout sections 76 located in the outer surface of the cylindrical seal.

In operation, the carrier liquid through hose 22 inlets openings 69, expanding the central portion of disc valve 66 permitting downstream flow through inner sleeve 77 of seal 73. Any flow in an upstream direction is blocked as the central valve area of disc 66 seats tightly against imperforate center section 71 of flow regulator 68. Also upon creation of any back pressure the same is relieved through notches 75 of cylindrical seal 73 and escapes in a downstream direction via cutouts 76 and through a relief hole 80 provided in the housing 21 (see FIG. 3).

Housing 21 is likewise coupled to liquid chemical container C via a standard internally threaded coupling 78 as an inner flange thereof engages a groove in end collar 79 of the housing. Disc seal 81 is disposed between collar 79 and the upper end of the container neck. The seal may have a non-circular central opening, such as rectangular, surrounding sleeve 82 which depends from housing 21 in coaxial alignment with liquid inlet passage 24. The non-circular opening in disc seal 81 thereby defines a plurality of openings establishing communication between vent ports 38, 39 and the interior of the container.

Figure 10:
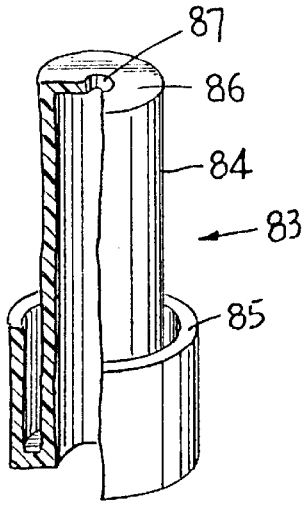
FIG. 10 is a perspective view of the dip tube retainer of the invention.

It is desirable to provide, unlike that found in the prior art, for a variety of chemical/water ratios depending on the garden/lawn conditions to be treated. A higher chemical-to-water ratio may be more desirable for treatment during different times of the year compared to a lower chemical-to-water ratio. Such a mix is made possible by the invention by the provision of a dip tube retainer 83 shown in each of the drawing FIGS. 2 to 6 and in more detail in FIG. 10. The dip tube retainer is in the form of an elongated cylinder 84 telescoped within sleeve 82, and has a spaced outer sleeve 85 at the lower end of the cylinder which defines an annular groove in which the lower end of sleeve 82 is received for snugly and tightly securing the tube retainer to sleeve 82 of the housing.

Cylinder 84 of the tube retainer has an upper end wall 86 containing an inlet port 87 coaxial with inlet passage 24. Thus in an open position of the valve the chemical is aspirated up the dip tube and into the liquid carrier stream via inlet ports 87 and 24 and duct 35. A given chemical-to-water ratio can be determined by the size of inlet port 87 in the inner wall of the dip tube retainer. For a smaller chemical/water ratio a dip tube retainer having a smaller diameter inlet port 87 will be made available giving instruction to the user to simply replace one for the other. Of course should a larger chemical/water ratio is desired, a dip tube retainer having a larger diameter inlet port 87 will be made available to the user with instructions to replace that tube retainer.

Valve 27 is co-injection molded whereby a first material of relatively hard plastic forms the basic valve which includes its cylindrical outer wall, closed end wall, spring legs 31, turning tab 36 and indicator bar 37. Annular seal rings 88, 89 are formed adjacent opposite ends of cylindrical outer wall 28 of the valve for sealing engagement with the confronting wall of bore 25 of the housing. And, seal portions 44 and 45 of the outer periphery of the valve wall, together with seal rings 88 and 89 are formed of a slightly softer plastic material compared to that of the end portion of the valve during the co-injection process. Channels 91 and 92 are formed in the outer periphery of the valve cylindrical wall for connecting seals 88, 89, seal portion 44 and seal portion 45 together. Thus during the co-injection process, the seals and connecting channels are formed of soft-plastic material utilizing a known co-injection process for this purpose. This avoids the time consuming and relatively more costly process of formulating cylindrical valves such as this with end seals and the like requiring use of a different material utilizing a separate process and requiring a sub-assembly process.

From the foregoing, it can be seen that a hose end trigger sprayer has been devised with a variety of distinctive features which simplify the operation, molding and assembly rendering the assembly according to the invention economical and easy to use yet highly efficient for outdoor garden and yard spray. The sprayer housing is easily handled by the operator by simply grasping the single handle bar thereby avoiding contact with the chemical/liquid mix being discharged. The manually rotatable nozzle diverts the spray forming a flat spray pattern upwardly or downwardly without the need for changing the attitude of the end held assembly. The nozzle likewise facilitates a rinsing of the control valve which permits a stream discharge with no flat pattern.

The replaceable dip tube retainer facilitates changing the chemical/water mix depending on the needs of the user. And the anti-siphon assembly provides for a unique and simple solution to prevent flow of chemical into the water system and to avoid the creation of any back pressure problems during operation. Moreover the cylindrical valve may be produced by co-injection of different materials, one of which is softer for providing integral seal rings adjacent opposing ends of the valve.

Obviously, many modifications and variations of the present invention are made possible in the light of the above teachings. It is therefore to be understood that within the scope of the appended claims, the invention may be practiced otherwise than as specifically described.

What is claimed is:

1. A sprayer assembly for connection to a container of a liquid chemical to be diluted upon aspiration by a pressurized stream of carrier liquid, comprising: a housing having a carrier liquid inlet passage, a chemical liquid inlet passage and a discharge passage; a valve mounted within said housing having means for interconnecting said inlet passages in a first rotative position of the valve, said means comprising a carrier liquid duct and a chemical liquid duct both integrally formed in said valve and opening into said carrier liquid duct, said valve being manually rotatable about an axis perpendicular to both said carrier liquid duct and said chemical liquid duct, and said valve having means for closing the inlet passages in a second rotative position of the valve.

2. The sprayer assembly according to claim 1, wherein said valve comprises a cylinder rotatable about an axis transverse to axes of said passages, said cylinder being mounted within a cylindrical bore of said housing.

3. The sprayer assembly according to claim 2, wherein said closing means comprises an outer surface of said valve in engagement with said bore in said second rotative position.

4. The sprayer assembly according to claim 1, wherein said valve has means for interconnecting said carrier liquid inlet passage with said discharge passage in a third rotative rinse position of the valve.

5. The sprayer assembly according to claim 4, wherein the housing has a transverse bore in which said valve is mounted, said valve comprising a cylinder, and said means for interconnecting said carrier liquid passage with said discharge passage comprising passageways on an outer surface of said valve in communication with said carrier liquid duct.

6. The sprayer assembly according to claim 1, wherein a vent port in said housing communicates with a vent port in said valve in only the first rotative position for communicating the interior of the container with the atmosphere.

7. The sprayer assembly according to claim 6, wherein said valve has a cylindrical wall containing said valve vent port, a cylindrical bore in said housing for the reception of said valve, said bore having a wall containing said housing vent port.

8. The sprayer assembly according to claim 1, further comprising means on said housing for diverting the flow of liquid from said discharge orifice.

9. The sprayer assembly according to claim 8, wherein said diverting means comprises a nozzle having at least one sloping wall for deflecting the liquid flow to effect a flat spray pattern in one direction.

10. The sprayer assembly according to claim 9, wherein said sloping wall has a roughened surface for dispersing the deflected liquid.

11. The sprayer assembly according to claim 8, wherein said diverting means comprises a rotatable nozzle having a pair of sloping walls for selectively deflecting the liquid flow to effect flat spray patterns respectively in selected directions.

12. The sprayer assembly according to claim 11, wherein said sloping walls have roughened surfaces for dispersing the deflected liquid.

13. The sprayer assembly according to claim 1, further comprising handle means on said housing for manually supporting the assembly in use.

14. The sprayer assembly according to claim 13, wherein said handle means comprises a gripping bar.

15. The sprayer assembly according to claim 1, further comprising means on said housing for coupling said carrier liquid inlet passage to a pressurized water source, said coupling means including anti-siphon means for preventing any flow of the carrier liquid toward the water source.

16. The sprayer assembly according to claim 15, wherein said anti-siphon means comprises one-way valve means.

17. The sprayer assembly according to claim 16, wherein said valve means comprises an elastomeric valve disc and a flow regulator.

18. The sprayer assembly according to claim 1, further comprising means connected to said housing for retaining a dip tube extending into the container.

19. The sprayer assembly according to claim 18, wherein said retaining means comprises a cylindrical cap having a bottom wall defining an inlet port in communication with said chemical liquid inlet passage.

20. The sprayer assembly according to claim 1, wherein said valve comprises a cylinder rotatable within a cylindrical bore of the housing, said cylinder having spaced annular seal rings, and the passages terminating in outwardly opening ports located between said seal rings.

21. The sprayer assembly according to claim 20, wherein said valve is entirely of molded polymeric material, the material forming the seal rings being softer and more compliant compared to the material forming the remainder of the valve.

22. The sprayer assembly according to claim 1, wherein said housing has a chemical liquid inlet opening and a depending support sleeve 82 coaxial with said opening, a dip tube retainer 83 coupled to said sleeve, said retainer having a cylindrical wall in frictional engagement with said sleeve, said cylindrical wall suspending a dip tube extending into the container, and said retainer having a transverse wall lying adjacent said inlet opening, said transverse wall having an inlet opening in open communication with said dip tube, said orifice having a predetermined size to effect a given chemical liquid-to-carrier liquid ratio.

23. A sprayer assembly for connection to a container of a liquid chemical to be diluted upon aspiration by a pressurized stream of carrier liquid, comprising a housing having a discharge passage, means mounted on said housing comprising a rotatable nozzle having a pair of spaced apart sloping walls with opposing sides respectively lying in the path of said passage upon nozzle rotation for diverting flow of the liquid from said discharge passage to effect flat spray patterns respectively in selected directions upon nozzle rotation.

24. The sprayer assembly according to claim 23, wherein said walls have roughened surfaces for dispersing the diverted liquid flow.

25. The sprayer assembly according to claim 23, wherein said walls are parallel and spaced apart, one of said walls having an outer deflecting surface when lying in said path, and the other of said walls having an inner deflecting surface when lying along said path.

26. A sprayer assembly for connection to a container of liquid chemical to be diluted upon aspiration by a pressurized stream of carrier liquid, comprising a housing having a discharge passage through which the carrier liquid is discharged, a nozzle mounted on said housing at said discharge passage for rotation between stream and spray positions, said nozzle having a pair of spaced sloping walls with respective opposing surfaces thereof lying in the path of said discharge passage in different rotative positions to effect spray patterns upon deflection in different directions, said walls lying out of the path of the discharge passage in another rotative position to permit a stream pattern discharge.

27. The sprayer assembly according to claim 26, wherein surfaces of said walls lying in said path are roughened for dispersing the spray.

28. The sprayer assembly according to claim 26, wherein the nozzle has an axis offset from an axis of the discharge nozzle.

29. A sprayer assembly for connection to a container of chemical liquid to be diluted upon aspiration by a pressurized stream of carrier liquid, comprising a housing having carrier liquid and chemical liquid inlet passages extending into a cylindrical bore and a discharge passage extending from said bore, said bore extending transversely to said passages, a cylindrical valve coaxial with and mounted in said bore for rotation about a central axis thereof between on and off positions, said valve having annular seal rings adjacent opposite ends in engagement with said bore, the entirety of said valve being of an injection molded polymeric material, the seal rings being of a co-injected material interconnected by channels provided during co-injection formation, and at least the material forming the seal rings being softer and more compliant compared to the material forming the valve.

30. The sprayer assembly according to claim 29, wherein said valve has inlet passage closing means for closing each of said passages in the off position.

31. The sprayer assembly according to claim 30, wherein said closing means comprise the softer and more compliant material.

32. The sprayer assembly according to claim 31, wherein the closing means are of co-injected material interconnected by channels provided during co-injection formation.

33. A spray assembly for connection to a container of chemical liquid to be diluted upon aspiration by a pressurized stream of carrier liquid, comprising a housing having an inlet conduit defining a carrier liquid inlet passage, a coaxial discharge passage, and a perpendicular related chemical liquid inlet passage, means for coupling said inlet conduit to a pressurized water source, said coupling means and said inlet conduit containing an anti-siphon assembly permitting only one way flow of carrier liquid into said carrier liquid inlet passage, said assembly including a cylindrical seal in engagement with a one-way valve disc and having back-pressure relief passages in communication with a relief hole located in the inlet conduit for the relief of any back pressure.

* * * * *

US006378785C1

(12) EX PARTE REEXAMINATION CERTIFICATE (5336th)

United States Patent
Dodd

(10) Number: US 6,378,785 C1
(45) Certificate Issued: Apr. 11, 2006

(54) HOSE-END ASPIRATION-TYPE SPRAYER

(75) Inventor: Joseph K. Dodd, Lee's Summit, MO (US)

(73) Assignee: Calmar Inc., City of Industry, CA (US)

Reexamination Request:
No. 90/006,377, Sep. 5, 2002

Reexamination Certificate for:

| | |
|---|---|
| Patent No.: | **6,378,785** |
| Issued: | **Apr. 30, 2002** |
| Appl. No.: | **09/650,635** |
| Filed: | **Aug. 30, 2000** |

(51) Int. Cl.
*B05B 7/30* (2006.01)

(52) U.S. Cl. ..... 239/318; 239/394; 239/507; 239/581.1; 239/414

(58) Field of Classification Search ..... 239/310, 239/318, 394, 407, 414, 581.1, 499, 505, 239/513, 511, 500, 501, 502, 522, 509, DIG. 19, 239/343
See application file for complete search history.

(56) References Cited

U.S. PATENT DOCUMENTS

| | | | | | |
|---|---|---|---|---|---|
| 3,186,643 | A | | 6/1965 | George et al. | |
| 3,212,716 | A | | 10/1965 | Mills et al. | 239/318 |
| 3,254,844 | A | * | 6/1966 | Blasnik et al. | 239/318 |
| 3,381,899 | A | * | 5/1968 | Forsman | 239/507 |
| 3,693,884 | A | * | 9/1972 | Snodgrass et al. | 239/DIG. 19 |
| 4,595,127 | A | | 6/1986 | Stoody | |
| 4,598,862 | A | * | 7/1986 | Rice | 239/343 |
| 4,890,792 | A | * | 1/1990 | Martin et al. | 239/343 |
| 5,213,264 | A | | 5/1993 | Styne | |
| 5,356,076 | A | | 10/1994 | Bishop | |
| 5,954,272 | A | | 9/1999 | Liao | |
| 6,471,141 | B1 | | 10/2002 | Smith et al. | |
| 6,578,776 | B1 | | 6/2003 | Shanklin et al. | |

* cited by examiner

*Primary Examiner*—Steven J. Ganey

(57) ABSTRACT

An aspiration-type sprayer assembly adapted for being coupled to both the end of the hose and to a chemical container has a housing including a carrier liquid inlet passage, a chemical liquid inlet passage and a discharge passage. The cylindrical rotatable valve within the housing has a carrier liquid duct and a chemical liquid duct opening into the carrier duct for interconnecting the inlet passage in a first rotative position of the valve, and the valve is capable of closing the inlet passages in a second rotative position of the valve. The rotatable nozzle versus the discharge in selective directions, and the assembly is capable of being manipulated by the provision of a handle grip. An anti-siphon assembly is provided at the coupling between the sprayer housing and the water hose end to avoid pressure and back flow from the sprayer. And chemical/water mix can be exchanged substituting the various tube retainers having different size inlet ports.

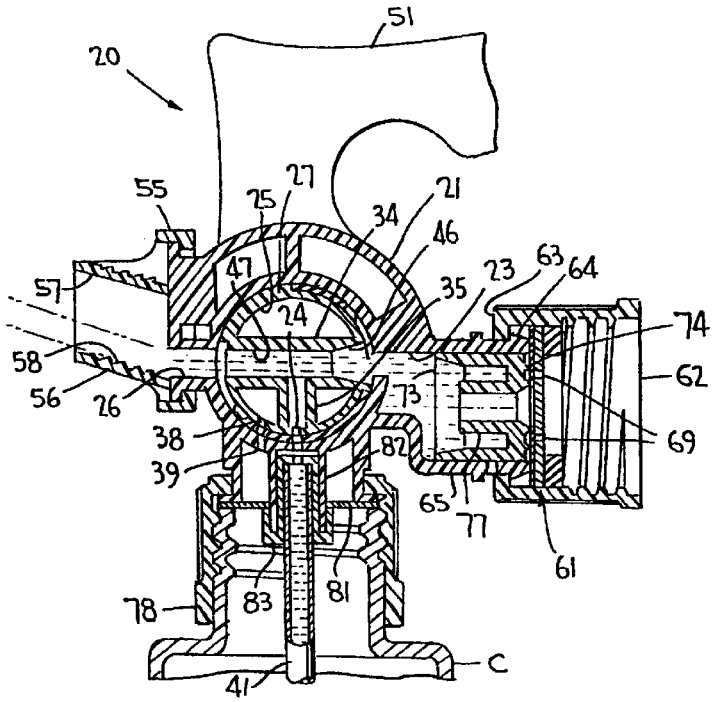

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claims 29–33 is confirmed.

Claims 6, 9, 15, 20 and 23–28 are cancelled.

Claims 1, 7, 10, 11, 16, 21 and 22 are determined to be patentable as amended.

Claims 2–5, 8, 12–14 and 17–19, dependent on an amended claim, are determined to be patentable.

New claims 34–39 are added and determined to be patentable.

1. A sprayer assembly for connection to a container of a liquid chemical to be diluted upon aspiration by a pressurized stream of carrier liquid, comprising: a housing having a carrier liquid inlet passage, a chemical liquid inlet passage and a discharge passage; a valve mounted within said housing having means for interconnecting said inlet passages in a first rotative position of the valve, said means comprising a carrier liquid duct and a chemical liquid duct both integrally formed in said valve and opening into said carrier liquid duct, said valve being manually rotatable about an axis perpendicular to both said carrier liquid duct and said chemical liquid duct, [and] said valve having means for closing the inlet passages in a second rotative position of the valve*, and said housing having a vent port in communication with a vent port in said valve in only the first rotative position for communicating the interior of the container with the atmosphere.*

7. The sprayer assembly according to claim [6] *1*, wherein said valve has a cylindrical wall containing said valve vent port, a cylindrical bore in said housing for the reception of said valve, said bore having a wall containing said housing vent port.

10. The sprayer assembly according to claim [9] *34*, wherein said sloping wall has a roughened surface for dispersing the deflected liquid.

11. The sprayer assembly according to claim [8] *34*, wherein [said diverting means comprises a rotatable nozzle having] *the nozzle is rotatable and has* a pair of sloping walls for selectively deflecting the liquid flow to effect flat spray patterns respectively in selected directions.

16. The sprayer assembly according to claim [15] *35*, wherein said anti-siphon means comprises one-way valve means.

21. The sprayer assembly according to claim [20] *36*, wherein said valve is entirely of molded polymeric material, the material forming the seal rings being softer and more compliant compared to the material forming the remainder of the valve.

22. The sprayer assembly according to claim 1, wherein said housing has a chemical liquid inlet opening and a depending support sleeve [82] coaxial with said opening, a dip tube retainer [83] coupled to said sleeve, said retainer having a cylindrical wall in frictional engagement with said sleeve, said cylindrical wall suspending a dip tube extending into the container, and said retainer having a transverse wall lying adjacent said inlet opening, said transverse wall having an inlet opening in open communication with said dip tube, said orifice having a predetermined size to effect a given chemical liquid-to-carrier liquid ratio.

*34. A sprayer assembly for connection to a container of a liquid chemical to be diluted upon aspiration by a pressurized stream of carrier liquid, comprising: a housing having a carrier liquid inlet passage, a chemical liquid inlet passage and a discharge passage; a valve mounted within said housing having means for interconnecting said inlet passages in a first rotative position of the valve, said means comprising a carrier liquid duct and a chemical liquid duct both integrally formed in said valve and opening into said carrier liquid duct, said valve being manually rotatable about an axis perpendicular to both said carrier liquid duct and said chemical liquid duct, said valve having means for closing the inlet passages in a second rotative position of the valve, and a nozzle on said housing having at least one sloping wall for deflecting the flow of liquid from the discharge orifice to effect a flat spray pattern in one direction.*

*35. A sprayer assembly for connection to a container of a liquid chemical to be diluted upon aspiration by a pressurized stream of carrier liquid, comprising: a housing having a carrier liquid inlet passage, a chemical liquid inlet passage and a discharge passage; a valve mounted within said housing having means for interconnecting said inlet passages in a first rotative position of the valve, said means comprising a carrier liquid duct and a chemical liquid duct both integrally formed in said valve and opening into said carrier liquid duct, said valve being manually rotatable about an axis perpendicular to both said carrier liquid duct and said chemical liquid duct, said valve having means for closing the inlet passages in a second rotative position of the valve, and means on said housing for coupling said carrier liquid inlet passage to a pressurized water source, said coupling means including anti-siphon means for preventing any flow of the carrier liquid toward the water source.*

*36. A sprayer assembly for connection to a container of a liquid chemical to be diluted upon aspiration by a pressurized stream of carrier liquid, comprising: a housing having a carrier liquid inlet passage, a chemical liquid inlet passage and a discharge passage; a valve mounted within said housing having means for interconnecting said inlet passages in a first rotative position of the valve, said means comprising a carrier liquid duct and a chemical liquid duct both integrally formed in said valve and opening into said carrier liquid duct, said valve being manually rotatable about an axis perpendicular to both said carrier liquid duct and said chemical liquid duct, said valve having means for closing the inlet passages in a second rotative position of the valve, and wherein said valve comprises a cylinder rotatable within a cylindrical bore of the housing, said cylinder having spaced annular seal rings, and the passages terminating in outwardly opening ports located between said seal rings.*

*37. A sprayer assembly for connection to a container of liquid chemical to be diluted by a pressurized stream of a carrier liquid, comprising: a housing having a carrier liquid*

*inlet passage, a chemical liquid inlet opening and a discharge passage; a valve mounted within said housing having means for interconnecting said carrier liquid inlet passage and said chemical inlet opening in a first rotative position of the valve, said means comprising an integral carrier liquid duct and an integral chemical liquid duct opening into said carrier liquid duct, said valve being manually rotatable about an axis perpendicular to both said carrier liquid duct and said chemical liquid duct, the sprayer assembly having vent means establishing communication between an interior of the container and atmosphere, and said valve having means for disconnecting said carrier liquid inlet passage from said chemical liquid inlet opening and for interrupting communication between the interior of the container and atmosphere in a second rotative position of the valve.*

*38. The sprayer assembly according to claim 37, wherein said means for disconnecting and for interrupting comprises an outer surface of said valve in engagement with a surface of a transverse bore in said housing receiving said valve.*

*39. The sprayer assembly according to claim 37, wherein said vent means comprises a vent port in said housing in communication with a vent port in said valve in said first rotative position.*

* * * * *